US006148996A

United States Patent [19]

Morini

[11] Patent Number: 6,148,996

[45] Date of Patent: Nov. 21, 2000

[54] PACKAGE FOR KEEPING PRODUCTS SEPARATE BEFORE USE

[75] Inventor: Emilio Morini, Colorno, Italy

[73] Assignee: Bormioli Rocco & Figlio S.p.A., Parma, Italy

[21] Appl. No.: 09/380,286

[22] PCT Filed: Sep. 10, 1997

[86] PCT No.: PCT/IT97/00222

§ 371 Date: Aug. 30, 1999

§ 102(e) Date: Aug. 30, 1999

[87] PCT Pub. No.: WO98/38104

PCT Pub. Date: Sep. 3, 1998

[30] Foreign Application Priority Data

Feb. 28, 1997 [IT] Italy ..... MO97A0029

[51] Int. Cl.[7] ..... B65A 25/08

[52] U.S. Cl. ..... 206/222; 215/DIG. 8

[58] Field of Search ..... 215/251, 256, 215/257, DIG. 8; 206/219, 221, 222

[56] References Cited

U.S. PATENT DOCUMENTS

| | | | |
|---|---|---|---|
| 3,156,369 | 11/1964 | Bowes et al. | 206/222 |
| 3,840,136 | 10/1974 | Lanfranconi et al. . | |
| 3,920,141 | 11/1975 | Bojardi | 215/251 |
| 4,195,730 | 4/1980 | Hunt | 206/221 |
| 4,195,731 | 4/1980 | Cavazza . | |
| 4,615,437 | 10/1986 | Finke et al. | 206/222 |
| 4,982,875 | 1/1991 | Pozzi et al. . | |
| 5,029,718 | 7/1991 | Rizzardi | 206/222 X |
| 5,038,951 | 8/1991 | Rizzardi | 206/222 X |

FOREIGN PATENT DOCUMENTS

| | | |
|---|---|---|
| 1 568 362 | 5/1969 | France . |
| 44 10 323 | 9/1995 | Germany . |

*Primary Examiner*—Bryon P. Gehman
*Attorney, Agent, or Firm*—Browdy & Neimark

[57] ABSTRACT

A package for keeping products separate until use comprises a container (1) provided with an upper mouth (2) inside which a capsule (3) is inserted; the capsule having a bottom (4) which is destined at the moment of use of the package to be broken by a cutting element (11). A cap (13) covers the capsule (3) and the cutting element (11), and is screwed on a sleeve (6) solidly constrained to the capsule (3). When a security strip (16) is removed the cap (13) can be screwed, placing a pressure on the cutting element (11) which causes the capsule (3) to be ruptured and a product contained therein to mix with a product contained in the container.

9 Claims, 2 Drawing Sheets

PACKAGE FOR KEEPING PRODUCTS SEPARATE BEFORE USE

CROSS REFERENCE TO RELATED APPLICATION

The present application is the national stage under 35 U.S.C. 371 of PCT/IT97/00222, filed Sep. 10, 1997.

TECHNICAL FIELD

The invention relates to a package for keeping products separate before use. For some time now the market has offered medicines packaged in two separate phases: the first of the medicines is a powder, while the second is a liquid, and they have to be kept separate until the moment of use. Packages for such medicinal mixtures comprise a container for the liquid and a capsule for the powders, which are set in communication just before use so that they can mix.

BACKGROUND ART

One of the packages of the above-described type on the market is provided with a cutting element which by means of a pressure applied thereto inserts into the liquid container, which is closed off by a thin membrane; the cutting element ruptures the membrane so that the powders can penetrate into the container. A package of this type is described, for example, in Italian patent for industrial invention no. 1,066, 140, wherein the cutting element is in fact a hollow cylinder with an oblique-section end, made in a single piece with walls which close the mouth of the container. This package exhibits a lateral strip, removable by tugging along two easy-break parallel lines exhibiting a tab-pull; the user can grip this stip, the removal of which enables the cutting element to make an axial movement. When it is desired to mix the powder with the liquid solvent, the strip must first be removed and then the cutting element pressed using a finger so that the bottom of the little powder container is ruptured and the powders can mix with the liquid.

Another prior-art package comprises a protection hood, which covers the cutting element and the powder container and which is destined to be removed by tearing at the moment of use in order that the cutting element can be pressed. A package of this type is shown, for example, in Italian application for industrial invention no. RM91A000831.

The prior art comprises U.S. Pat. No. 4,982,875 which discloses a package comprising a capsule inserted internally of the upper mouth of the container. The capsule is superiorly open and is separated from the inside of the container. The capsule has a breakable bottom. A rupturing of the bottom setting the capsule in communication with the inside of the container. A cutting element is inserted internally of the capsule. The cutting element has a bottom end destined in use to break the bottom of the capsule. A cap is arranged on the container in such a way as to cover the capsule and the cutting element. The cap exhibits a thread with which a screw-coupling is achieved, by means of which coupling the cap can move axially downwards with respect to the container. The axial downward movement causes the cap to interact with the cutting element in order to rupture the bottom of the capsule.

The prior-art packages contain some drawbacks.

Firstly, in order to avoid a deterioration of the powder quality, the coupling between the external surface of the cutting element and the internal surface of the powder container must be sealed to guarantee a hermetic seal on the container. However, the correct realisation of such coupling is especially difficult to achieve, inasmuch as if the coupling is too tight, a strong pressure will have to be applied to the cutting element, which is not only hard to do but can cause the user to perform the operation wrongly, i.e. not by pressing with a finger on the cap-capsule but by tipping up the package and pressing the cap against a solid surface. This can mean that the mixture is not obtained in the correct manner, as the powder does not fall directly into the liquid but vice-versa, leading to the formation of lumps which are difficult to remove from the cap-capsule. Thus a wrong mixture of the medicine is obtained.

In series production of plastic objects at industrial levels it is quite difficult to obtain size tolerances which would guarantee a constantly correct and desired connection between the cutting element and the cap-capsule.

A further problem in prior-art packages is as follows: at the moment of use, after the mixing phase of the substances (powders and liquid), the container is opened to allow the mixture to be removed. The powder container, which stays in the mouth of the container even after the cap has been extracted, represents an obstacle which can disturb the pouring-put of the mixture, making it irregular and discontinuous.

DISCLOSURE OF THE INVENTION

An aim of the present invention is to eliminate the above-described drawbacks by providing a package, simple in construction and economical, which guarantees the seal and security of the package before use and which enables the package to be opened simply and practically.

The invention allows the powder container to be set in communication with the liquid container by means of a simple screwing operation of the former on to the latter, requiring only a small effort on the part of the consumer, who, among other things, will not upturn the package in order to break the bottom of the cap-capsule and so will avoid the problem of lump-formation and the like.

Also, at the moment of use and after the mixture has been united, the powder-container can be removed from the mouth of the container together with the cap and the cutting element, so leaving the container mouth free of obstruction. An advantage of the invention is that is provides a package which is easily realisable and which is safe from liquid-permeation and which guarantees that the cap cannot be removed from the container until after the mixture of the two products has been obtained.

The above aims and others besides are all attained with the package of the invention, as it is characterised in the claims that follow.

Further characteristics and advantages of the present invention will better emerge from the detailed description that follows of a preferred but non-exclusive embodiment of the invention, illustrated purely by way of non-limiting example in the accompanying figures of the drawings, in which.

Figure 1:
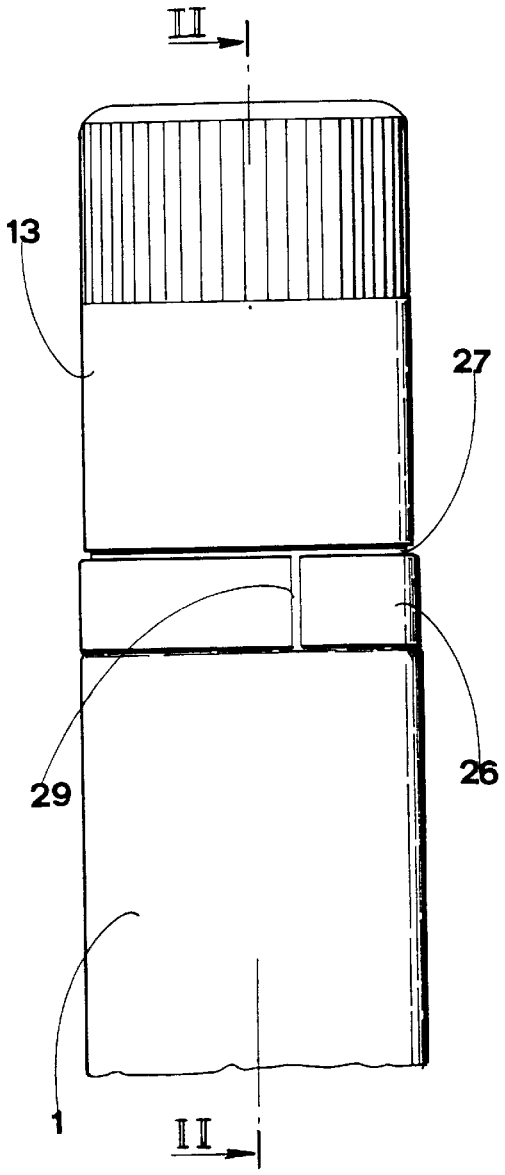
FIG. 1 is a vertical elevation of an embodiment of the package.

The package of the invention comprises a container 1, provided with an upper mouth 2, internally of which a superiorly-open capsule 3 is inserted slightly tight. The side surfaces of both the capsule 3 and the mouth 2, set in contact at the moment of packaging, guarantee a perfect seal against any possible leaking of the liquid from the container 1. The capsule 3 comprises a bottom 4 which is easily breakable along a peripheral easy-break line 5. The bottom 4 of the capsule 3 separates the liquid present in the container 1 from the capsule 3 itself. When the bottom 4 is ruptured the capsule 3 is set in communication with the inside of the container 1.

Figure 3:
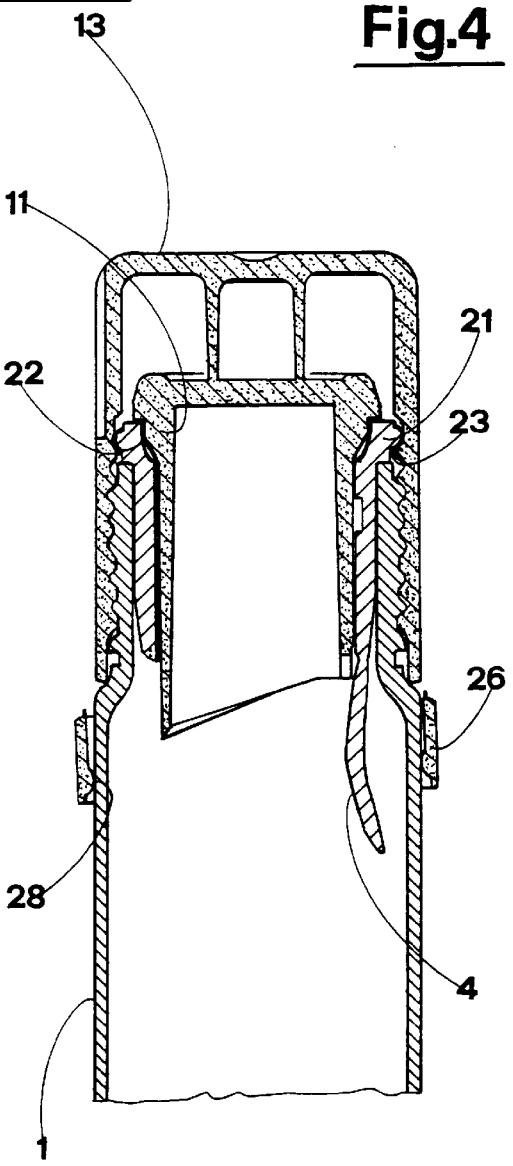
FIG. 3 is the section of FIG. 2 with the package in a different configuration in which the products, separated previously, are now in communication.

A cutting element 11, having the shape of a hollow cylindrical body, is predisposed internally of the capsule 3. The external surface of the cutting element 11 is coupled by slight sealing friction with the internal surface of the capsule 3. The lower end 12 of the cutting element 11 is sharpened inasmuch as it exhibits an oblique section, which pointed lower end 12 is destined in use to break through the capsule 3 by means of an applied pressure. FIG. 3 shows the package with the capsule 3 broken through by the cutting element 11 and set in communication with the inside of the container 1.

The package further comprises a cap 13 arranged on the container 1 in such a way as to cover the capsule 3 and the cutting element 11.

The various elements composing the package are made of plastic for medicinal use, of known type and in common use.

Figure 2:
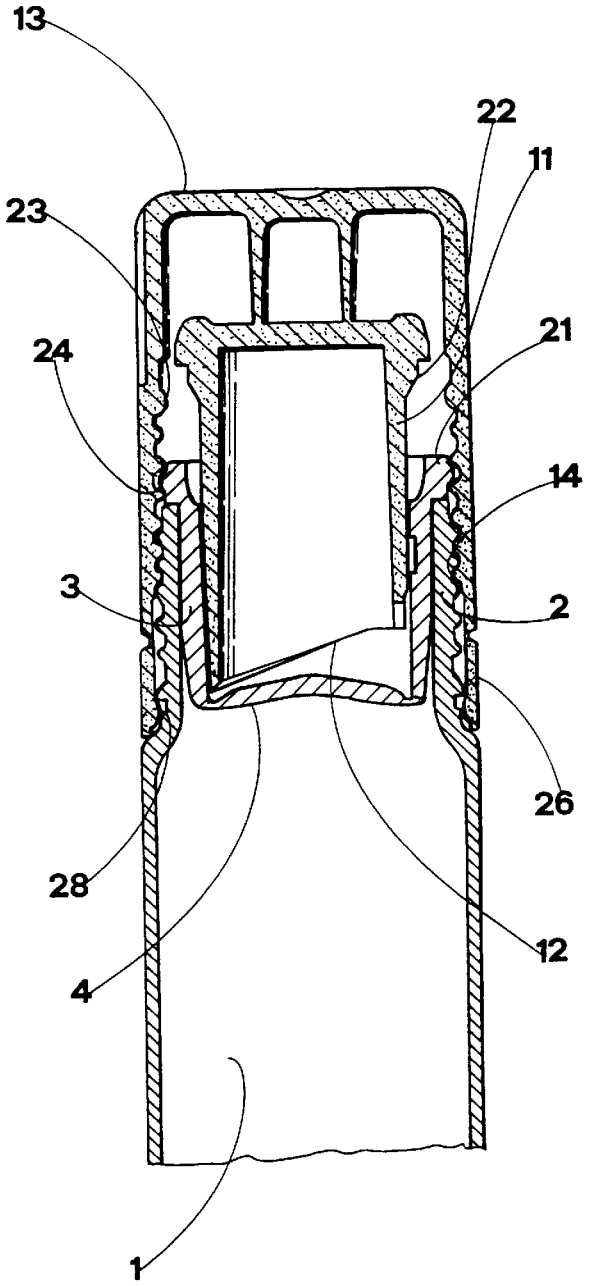
FIG. 2 is a section made according to line II—II of FIG. 1.

FIGS. 1 and 2 show the package before use, with the liquid (the solvent) in the container separated from the powder (the solute) in the capsule 3.

The cap 13 is screw-coupled directly on a thread 25 predisposed on the neck of the container 1.

The capsule 3 exhibits an upper part 21 situated above the upper margin of the mouth of the container 1. The internal diameter of the upper part 21 of the capsule 3 is greater than the external diameter of the cutting element 11 inserted sealedly in the capsule 3. In the assembled configuration of FIG. 2 (before use) the upper part 21 of the capsule 3 can thus be elastically deformed internalwise. The cutting element 11 exhibits a tract 22 which in use (when the package is to be used) is destined to contact the internal surface of the upper part 21 of the capsule, so as to prevent said upper part 21 from being deformed inwardly. An annular projection 23 internal of the cap 12 exhibits an internal diameter which is smaller than the internal diameter of the thread 14. During the downwards axial movement of the capsule 13, this annular projection 23 is destined to engage in an annular recess afforded on the upper part 21 of the capsule 3 so as to constrain the cap 13 and the capsule 3 one to the other in axial upward movement, with which the cap 3 is extracted from the container 1.

FIGS. 1 and 2 illustrate the package before use. The package exhibits a breakable ring 26 coaxially circling the container 1 and situated below the cap 13. The cap 13 and the ring 26 are united by means of easy-break perimeter ribs 27. The ring 26, which has the task of guaranteeing the security of the package, comprises an annular relief 28 coupled with the container 1 in such a way as to prevent or limit axial raising movements of the cap 13. The easy-break ring 26 resists attempts to unscrew and therefore raise the cap 13 (that is, to distance it from the ring 26), while it breaks easily when the cap 13 is lowered. The ring 26 further exhibits an easy-break axial line 29 along which the ring 26 can be opened. In FIGS. 1 and 2 the ring 26 is still unbroken. FIG. 3 illustrates the ring 26 open along the axial line 29 and detached from the cap 13.

At the moment of use the ring 26 detaches from the cap 13 and opens by screwing the cap 13 (FIG. 3). During the screwing-up operation, the cap 13 interacts contactingly with the cutting element 11 so that the latter is pressed downwards, breaking the bottom of the capsule. During this phase the upper annular part 21 of the capsule is deformed inwardly, bringing the internal projection 23 of the cap 13 to engage elastically in the recess 24 on the upper part 21 of the capsule. This is made possible by the fact that between the elastically-deformable upper annular part 21 of the capsule 3 and the external surface of the cutting element 11 there is a free space. At the end of the cap 13 screwing operation this free space no longer exists, since the above-mentioned tract 22 of cutting element 11 is in contact with the upper part 21 of the capsule. In the subsequent unscrewing phase of the cap 13 the capsule 3, made solid to the cap thanks to the coupling between the projection 23 and recess 24, is raised together with the cutting element 11. During the unscrewing phase the upper tract 22 of the capsule 3 can no longer deform inwardly—as in the screwing phase—since it is forced into contact between the tract 22 of cutting element 11 and the cap 13. The tract 22 of cutting element 11 having the greater diameter has thus the task of keeping the capsule 3 and the cap 13 solidly together during the extraction phase from the container 1.

On packaging, the liquid is poured into the container 1; the powder is placed in the capsule 3 which is then closed by the cutting element 11 with a hermetic and waterproof seal. The assembly is then inserted into the mouth 2 of the container 1. Subsequently the cap 13 is inserted; this is done in such a way that the annular relief 28 is constrained in the annular cavity afforded on the perimeter of the container 1. In this first conformation of the package, illustrated in FIGS. 1 and 2, the conformation in which the package is sold, the cap 13 is solidly anchored to the container 1 and is partially screwed on the counter itself. The cap 13 thus has a first function of preventing fraudulent access to the package and handling of the contents of the capsule 3 and the container 1. As has been described, at the moment of use the ring 26 is broken, so that the cap 13 is constrained to the container 1 only by the thread coupling.

The capsule 3 is placed in communication with the container 1 by simply rotating the cap 13, upon which the powder exit and mix with the liquid contents of the container 1. As in other known-type packages, a striker is provided to prevent the cutting element 11 from falling into the container 1. On completion of the cap 13 screwing operation the annular projection 23 is inserted into the annular recess 24 afforded on the upper part 21 of the capsule 3.

The second function of the cap 13 is to ensure that the above-described operation requires only a minimum effort on the part of the user, who will have no difficulty in performing the mixing operation, as he or she will only have to screw the cap 13. In the second configuration of the package, illustrated in FIG. 3, the cap 13 is still solidly anchored, thanks to the projection 23 and the recess 24, to the capsule and is free of the container 1, apart, obviously, from the screw coupling.

Figure 4:
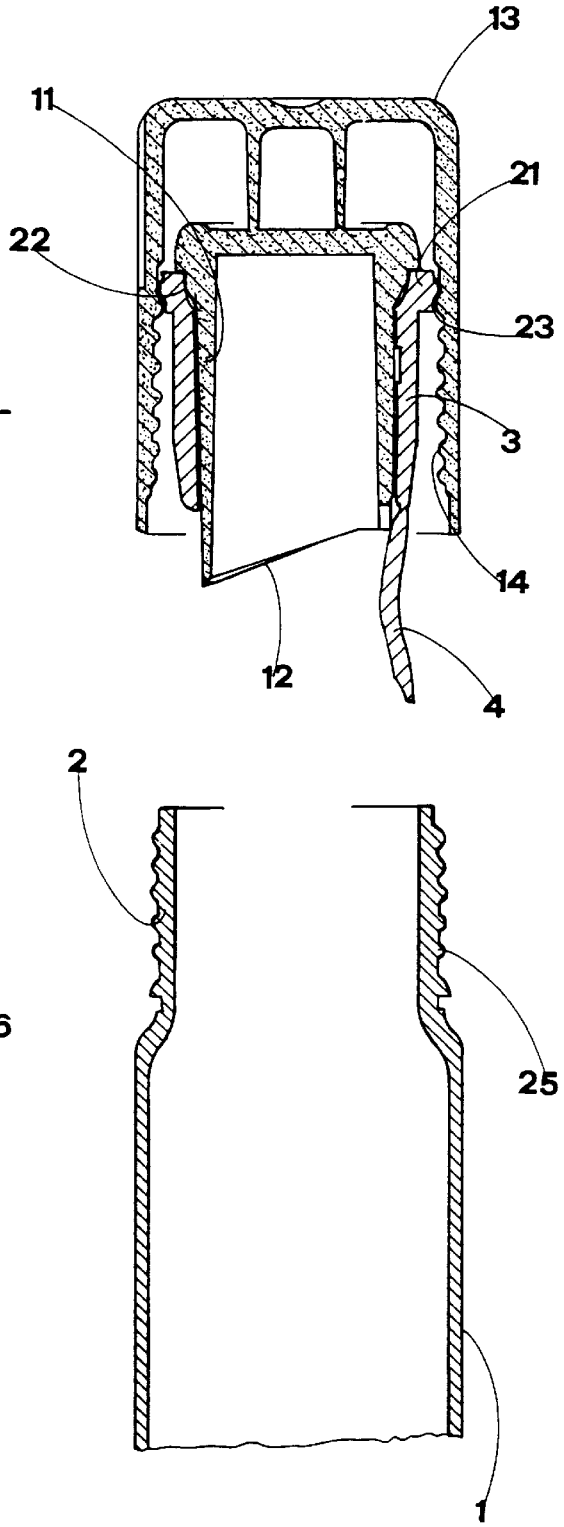
FIG. 4 is the package of FIG. 3 with the cap detached from the container.

It is now possible and indeed extremely easy to open the container 1; it is sufficient to unscrew the cap 13, which, translating axially upwarrds, draws the capsule 3 and the cutting element 11 both constrained thereto. This situation, in which the container 1 is accessible and contains the medicinal substance already mixed, is illustrated in FIG. 4.

The package has been described with reference to the pharmaceutical field, but can be used in other fields besides, for example cosmetics, chemistry, food and others, wherever it is necessary to commercialize substances, not necessarily powders and liquids as described herein, but any substances which have to be kept apart until the moment of use.

What is claimed is:

1. A package for keeping products separate before use, comprising:

a container (1) provided with an upper mouth (2);

a capsule (3) inserted internally of the mouth (2) of the container (1), superiorly open, an inside of the capsule (3) being separated from an inside of the container (1), the capsule (3) being provided with a breakable bottom (4), a rupturing of said breakable bottom (4) setting said capsule (3) in communication with the inside of the container (1);

a cutting element (11) inserted internally of said capsule (3), provided with a bottom end (12) destined in use to break the bottom (4) of the capsule (3);

a cap (13) arranged on the container (1) in such a way as to cover the capsule (3) and the cutting element (11);

wherein the cap (13) exhibits a thread (14) with which a screw-coupling is achieved, by means of which coupling the cap (13) can move axially downwards with respect to the container (1), so that axial downward movement causes the cap (13) to interact with the cutting element (11) in order to rupture the bottom (4) of the capsule (3);

characterized in that the cap (13) internally exhibits a projection (23) destined, by effect of downward axial movement of the cap (13), to engage in an upper part (21) of the capsule (3) which is elastically deformable in an internalwise direction, such as to constrain the cap (13) to the capsule (3) in upward axial movements for extraction from the container (1).

2. The package of claim 1, comprising means for blocking in position the upper part (21) of the capsule (3), which means for blocking intervene after the projection (23) has engaged in said upper part (21).

3. The package of claim 2, wherein said means for blocking said upper part (21) comprises a tract (22) of the cutting element (11) conformed and arranged so as to meet with the internal surface of the upper part (21) of the capsule (3).

4. The package of claim 1, wherein said projection (23) and said upper part (21) of the capsule (3) are annular shaped.

5. The package of claim 1, wherein the cap (13) is screw-coupled directly on to the neck of the container (1).

6. The package of claim 1, comprising a breakable ring (26), predisposed below the cap (13), destined to break by effect of downward axial movement of the cap (13).

7. The package of claim 6, wherein said ring (26) can be opened along an easy-break axial line (29).

8. The package of claim 6, wherein said ring (26) is joined to the cap (13) along an easy-break perimeter line.

9. The package of claim 6, wherein the breakable ring (26) exhibits an annular relief (28) coupled with the container (1) in such a way as to prevent or limit upward axial movements of the cap (13).

* * * * *